US008579408B2

(12) United States Patent
Kelly et al.

(10) Patent No.: US 8,579,408 B2
(45) Date of Patent: Nov. 12, 2013

(54) SYSTEM AND METHOD FOR MEASURING FLUID DROP MASS WITH REFERENCE TO TEST PATTERN IMAGE DATA

(75) Inventors: Conor D. Kelly, Albany, OR (US); Mark R. Parker, Portland, OR (US); Lisa M. Schmidt, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 305 days.

(21) Appl. No.: 13/097,376

(22) Filed: Apr. 29, 2011

(65) Prior Publication Data

US 2012/0274684 A1 Nov. 1, 2012

(51) Int. Cl.
*B41J 29/393* (2006.01)

(52) U.S. Cl.
USPC ..... 347/19; 347/10; 347/5

(58) Field of Classification Search
USPC ..... 347/5, 9, 10, 16, 19
See application file for complete search history.

(56) References Cited

U.S. PATENT DOCUMENTS

| | | | | |
|---|---|---|---|---|
| 6,783,210 | B2 | 8/2004 | Takahashi et al. | |
| 7,407,246 | B2 | 8/2008 | Vanhooydonck | |
| 7,597,418 | B2 | 10/2009 | Mantell et al. | |
| 2009/0096823 | A1 | 4/2009 | Watt et al. | |
| 2010/0156987 | A1 * | 6/2010 | Yip et al. | 347/19 |
| 2010/0238220 | A1 | 9/2010 | Yeh et al. | |

* cited by examiner

*Primary Examiner* — Lam S Nguyen
(74) *Attorney, Agent, or Firm* — Maginot, Moore & Beck, LLP

(57) ABSTRACT

A method measures distances between two printed lines on a rotating image receiving member to identify fluid drop mass or fluid drop velocity changes in inkjet ejectors in an inkjet printing system. An initial distance between the two lines is measured at the start of the operational life of the system. During the line of the printing system, the lines are reprinted and the distance between the two lines compared to the initial distance. If the distance has changed by more than a predetermined amount, a firing signal for the printheads that printed the lines is adjusted.

20 Claims, 4 Drawing Sheets

SYSTEM AND METHOD FOR MEASURING FLUID DROP MASS WITH REFERENCE TO TEST PATTERN IMAGE DATA

TECHNICAL FIELD

This disclosure relates generally to ink drop mass measurement for an imaging device having one or more printheads, and, more particularly, to ink drop mass measurements based on test pattern image data.

BACKGROUND

Inkjet printers have printheads that operate a plurality of inkjet ejectors from which liquid ink is expelled. The ink may be stored in reservoirs located within cartridges installed in the printer, or the ink may be provided in a solid form and then melted to generate liquid ink for printing. In these solid ink printers, the solid ink may be in either pellets, ink sticks, granules or any other forms. The solid ink pellets or ink sticks are typically placed in an "ink loader" that is adjacent to a feed chute or channel. A feed mechanism moves the solid ink sticks from the ink loader into the feed channel and then urges the ink sticks through the feed channel to a heater assembly where the ink is melted. In some solid ink printers, gravity pulls solid ink sticks through the feed channel to the heater assembly. Typically, a heater plate ("melt plate") in the heater assembly melts the solid ink impinging on it into a liquid that is delivered to a printhead for jetting onto a recording medium.

A typical inkjet printer uses one or more printheads. Each printhead typically contains an array of individual nozzles for ejecting drops of ink across an open gap to an image receiving member to form an image. The image receiving member may be recording media or it may be a rotating intermediate image receiving member, such as a print drum or belt. In the printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual drops at particular locations of a pixel array defined for the receiving medium. The locations are sometimes called "drop locations," "drop positions," or "pixels." Thus, the printing operation can be viewed as the filling of a pattern of drop locations with drops of ink.

Some inkjet printheads, such as phase change inkjet printheads, utilize inks that have melting points of 80° C. and higher. With many of these inks, optimal jetting occurs at significantly higher temperatures, such as 100°-120° C. and above. Consequently, during printing the inkjets and other printhead components must be maintained at or above these elevated jetting temperatures. The temperature of the ink reservoirs supplying liquid ink to the inkjets must also be maintained at or near the required jetting temperatures.

Prolonged use of an inkjet printhead at elevated temperatures can alter printhead performance and accelerate thermal stress or aging of the printhead components. Thermal aging, also known as drift, can result in image degradation due to performance variations. For example, the drop mass of ejected ink drops can vary as the printhead components are thermally conditioned over time. Variations in drop mass from nozzle to nozzle of a printhead or from printhead to printhead in a multiple printhead system may result in result in banding or streaking of a printed image, blurred edges to lines or shapes due to positional errors resulting from drift, or low intensity in solid colors.

To reduce ink drop mass variations due to thermal aging of the printheads of an inkjet printer, previously known systems implemented an open loop process in which a controller altered the voltage level of the firing signals for the printhead over time at a predefined rate that was designed to compensate for the drift of a generic printhead. The variability of the drift behavior between different printheads in a printer, however, may be significant and may be in opposite directions. Therefore, adjusting the driving voltages of the printheads in this manner may eventually result in printheads outputting drops at different drop masses.

SUMMARY

A method enables the adjustment of firing signal voltages to compensate for changes in the mass of ink drops emitted by at least one inkjet of an inkjet imaging device. The method comprises ejecting a first line of ink drops across a rotating image receiving member in a cross-process direction, ejecting a second line of ink drops across the rotating image receiving member in the cross-process direction, the second line being generated to be placed on the first line of ink drops, identifying a distance between a first portion of the first line of ink drops and a first portion of the second line of ink drops, storing the identified distance in association with a printhead that ejected the ink drops in the first portion of the first line of ink drops and the first portion of the second line of ink drops.

A second method has also been developed that enables the adjustment of firing signal voltages to compensate for changes in the mass of ink drops emitted by at least one inkjet of an inkjet imaging device. The method comprises ejecting a first line of ink drops across a rotating image receiving member in a cross-process direction, displacing each printhead that ejected the first line of ink drops by a predetermined distance, ejecting a second line of ink drops across the rotating image receiving member in the cross-process direction, the second line being generated to be placed on the first line of ink drops, identifying a distance between a first portion of the first line of ink drops and a first portion of the second line of ink drops, storing the identified distance in association with a printhead that ejected the ink drops in the first portion of the first line of ink drops and the first portion of the second line of ink drops.

A system has been developed that implements either adjustment method in an imaging device. The system includes an optical sensing device configured to generate image data of a surface of a rotating image receiving member, a printhead assembly having a plurality of printing devices that eject ink towards a surface of the rotating image receiving member, and a controller operatively connected to the optical sensing device and the printhead assembly, the controller being configured to operate the printheads in the printhead assembly to eject a first line of ink drops across the rotating image receiving member in a cross-process direction and to eject a second line of ink drops across the rotating image receiving member in the cross-process direction, the second line being generated to be placed on the first line of ink drops, to identify a distance between a first portion of the first line of ink drops and a first portion of the second line of ink drops, and to store the identified distance in association with a printhead that ejected the ink drops in the first portion of the first line of ink drops and the first portion of the second line of ink drops.

BRIEF DESCRIPTION OF THE DRAWINGS

The foregoing aspects and other features of a printer implementing a firing signal adjustment for multiple printheads are explained in the following description, taken in connection with the accompanying drawings, wherein.

DETAILED DESCRIPTION

Figure 1:
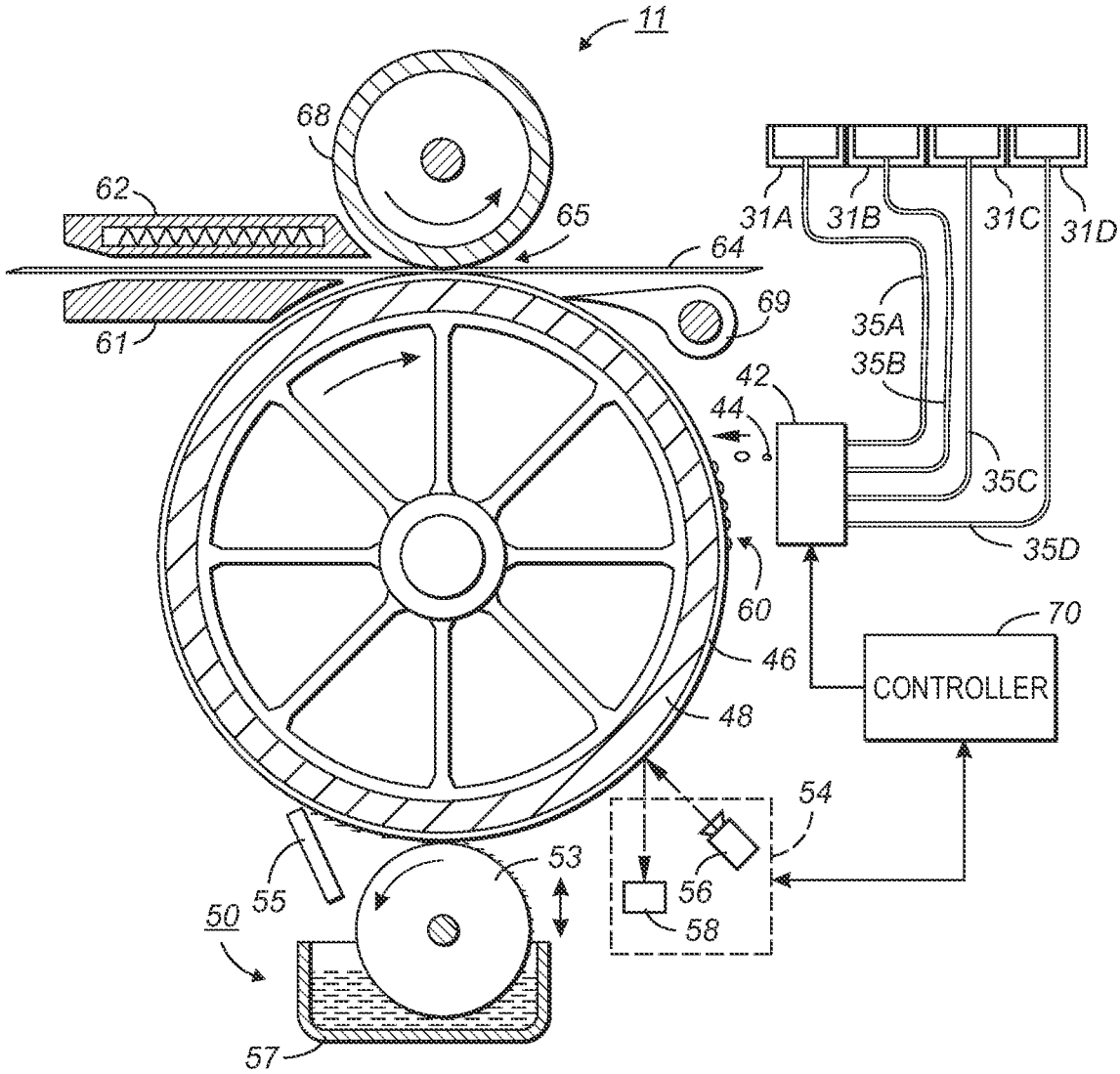
FIG. 1 is a schematic view of a solid ink imaging device.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. The systems and methods described below may be used with various indirect printer embodiments where ink images are formed on an intermediate image receiving member, such as a rotating imaging drum or belt, and the ink images are subsequently transfixed on media sheets. The systems and methods may also be used in printer embodiments that form images directly on the media sheets. The direction in which the image receiving member moves is called the "process direction" in this document and the direction across the image receiving member that is perpendicular to the process direction is called the "cross-process direction." A "media sheet" or "recording medium" as used in this description may refer to any type and size of medium on which printers produce images, with one common example being letter sized printer paper. Each media sheet includes two sides, and each side may receive an ink image corresponding to one printed page. An "ink" as used in this document, may be any fluid ejected onto a media sheet, such as molten wax, resins, aqueous solutions, gels, or emulsions. Also, as used in this document, the words "calculate" and "identify" include the operation of a circuit comprised of hardware, software, or a combination of hardware and software that reaches a result based on one or more measurements of physical relationships with accuracy or precision suitable for a practical application.

Referring to FIG. 1, a phase change ink imaging system 11 is shown. For the purposes of this disclosure, the imaging apparatus is in the form of an inkjet printer that employs one or more inkjet printheads and an associated solid ink supply. However, the present invention is applicable to any of a variety of other imaging apparatus, including for example, facsimile machines, copiers, or any other imaging apparatus capable of applying one or more marking agents to a medium or media. The marking agent may be ink, wax, polymers, plastic resins, gel inks, UV curable gel inks, or any suitable substance that may include one or more dyes or pigments and that may be applied to the selected media. The marking agent may be clear, black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The imaging device of FIG. 1 includes a printhead assembly 42 that is appropriately supported to emit drops 44 of fluid, such as ink, onto an imaging receiving member 48 that is shown in the form of a drum, but can equally be in the form of a supported endless belt. In other embodiments, the printhead assembly ejects drops of ink directly onto a print media substrate without using an intermediate transfer surface. The imaging device 11 has an ink supply (not shown) which receives and stages solid ink sticks. An ink melt unit (not shown) heats the solid ink above its melting point to produce liquefied ink which is supplied to the reservoirs 31A, 31B, 31C, 31D. The ink is then supplied from the ink reservoirs 31A, 31B, 31C, 31D to printheads within the printhead assembly 42 via the ink conduits 35A, 35B, 35C, 35D that connect the ink reservoirs to the printheads in the printhead assembly 42.

The exemplary printing mechanism 11 further includes a substrate guide 61 and a media preheater 62 that guides a print media substrate 64, such as paper, through a nip 65 formed between opposing actuated surfaces of a transfix roller 68 and the intermediate transfer surface 46 supported by the print drum 48. Stripper fingers or a stripper edge 69 can be movably mounted to assist in removing the print medium substrate 64 from the image receiving surface 46 after an image 60 comprised of deposited ink drops is transferred to the print medium substrate 64.

Operation and control of the various subsystems, components and functions of the device 11 are performed with the aid of a controller 70. The controller 70 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the ink drop mass measurement function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Figure 2:
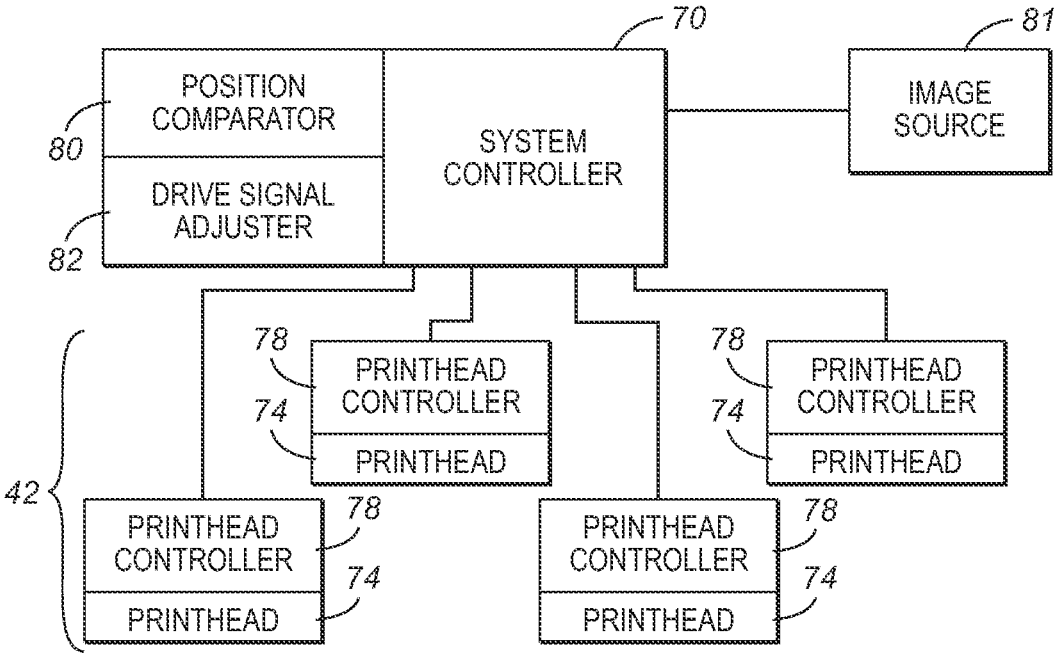
FIG. 2 is a schematic diagram of the printhead assembly and controller.

FIG. 2 is a schematic diagram of an embodiment of a printhead assembly 42 and controller 70. The printhead assembly 42 may include a plurality of printheads 74. FIG. 2 shows an embodiment of a printhead assembly having four printheads 74, each of which is controlled by a printhead controller 78. The printheads may be arranged end-to-end in a direction transverse to the receiving surface path in order to cover different portions of the receiving surface. The end-to-end arrangement enables the printheads 74 to form an image across the full width of the image transfer surface of the imaging member or a substrate. In another embodiment, the two printheads may be arranged to cover a portion of one row and the other two printheads arranged to cover a portion of another row. The two printhead arrangements may be translated in a cross-process direction to complete a printed row of pixels across the width of an image receiving member. In yet another embodiment, the four printheads may be arranged in a staggered array to enable the four printheads to print a single row of pixels across a width of an image receiving member as known in the art. In other embodiments, a single printhead or more than four printheads are used.

The operation of each printhead is controlled by one or more printhead controllers 78. In the embodiment of FIG. 2, one printhead controller 78 is operatively connected to each printhead. The printhead controllers 78 may be implemented in hardware, firmware, or software, or any combination of these. Each printhead controller may have a power supply (not shown) and memory (not shown). Each printhead controller 78 is operable to generate a plurality of firing signals with reference to a default ink drop mass firing signal to operate selected individual inkjets (not shown) of the respective printheads to eject drops of ink 44 (FIG. 1). A default ink drop mass firing signal is a firing signal having an amplitude and a frequency that operate the inkjet ejectors in a printhead to eject ink drops having a predetermined ink drop mass. The printhead controllers generate firing signals with reference to the default ink drop mass firing signal to eject ink drops having a mass that is different than the default mass. Firing signals are sent to an actuator in an inkjet ejector to expel ink from a nozzle of the ejector as is well known to those skilled in the art. The voltage level, or amplitude, of the firing signal may be varied to adjust the mass of a drop ejected from a nozzle. Each inkjet employs a drop ejector that responds to the firing signal. Exemplary ink drop ejectors include, but are not limited to, piezoelectric, thermal, and acoustic type ejectors. In another embodiment, a single controller supplies firing signals to all of the printheads to operate the inkjet ejectors in the printheads.

During operations, the controller 70 receives print data from an image data source 81. The image data source 81 can be any one of a number of different sources, such as a scanner, a digital copier, a facsimile device, a personal computer, a smart phone, or a device suitable for storing and/or transmitting electronic image data, such as a client or server of a network, or onboard memory or a memory cartridge, such as a thumbnail drive. The print data may include various components, such as control data and image data. The control data includes instructions that direct the controller to perform various tasks that are required to print an image, such as paper feed, carriage return, printhead positioning, or the like. The image data are the data corresponding to the image pixels to be formed by a printhead. The print data can be compressed and/or encrypted in various formats.

The controller 70 generates the printhead image data for each printhead 74 of the printhead assembly 42 from the control and print data received from the image source 81 and outputs the image printhead data to the appropriate printhead controller 78. The printhead image data may include the image data particular to the respective printhead. In addition, the printhead image data may include printhead control information. The printhead control information may include information such as, for example, instructions to adjust the drop mass generated by a particular printhead or inkjet. The printhead controllers 78 upon receiving the respective control and print data from the controller, generate firing signals for driving actuators in the inkjets to expel ink in accordance with the print and control data received from the controller. Thus, a plurality of drops may be ejected at specified positions and at specified masses on the image receiving member in order to produce an image in accordance with the print data received from the image source.

The imaging device may include an optical sensing device 54 (FIG. 1). The optical sensing device is configured to detect, for example, the presence, intensity, and/or location of ink drops jetted onto the receiving member by the inkjets of the printhead assembly 42. In one embodiment, the optical sensing device includes a light source 56 and a light sensor 58. The light source 56 may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The optical sensing device 54 is operatively connected to the controller 70. This connection enables the controller to operate the optical sensing device 54 selectively and receive image data generated by the optical sensing device. In another embodiment, monochrome illumination alone is directed towards the image substrate. In yet another embodiment, a single broad spectrum illuminator is used to direct light towards the image substrate and absorbing filters are used to obtain the reflected red, green, and red components. The controller 70 executes programmed instructions stored in memory to process the image data as described below to detect changes in the mass of the ejected ink drops and adjust the default ink drop mass firing signal in a printhead controller, if necessary.

The reflected light is measured by the light sensor 58. The light sensor 58, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Each sensor detects an amount of light reflected by an area of the image receiving member. If that area is covered by ink, the reflectance value generated by the sensor is lower than a sensor detecting a bare area of the image receiving member. Thus, the reflectance values generated by the sensors can be used to detect ink drops on the receiving member because the location of the sensor in the sensor array can be correlated to a drop position on the image receiving member. The light sensor 58 is configured to output reflectance signals generated by the sensor array to the print controller 70. The relative amplitudes of the reflectance signals are used to identify the color of the ink covering the image receiving member at a pixel location. For example, the controller may include a position comparator 80 (FIG. 2) for comparing detected ink drop locations or positions to expected ink drop positions to determine any differences in ink drop positions for the inkjets. Using this information, the controller can detect changes in the masses of the ink drops ejected by the printhead controller and make adjustments to the default ink drop mass firing signal, if necessary. These adjustments enable the default ink drop mass firing signal to operate the inkjet ejectors in a printhead to eject ink drops having approximately the same mass as the default mass ink drops initially ejected by the ejectors. In order to adjust or modulate the mass of the ink drops ejected by the inkjets, the print controller includes a drive signal adjuster 82 (FIG. 2) that is configured to adjust the voltage level, or amplitude, of one or more segments, or pulses, of the firing signal. In one embodiment, in order to increase or decrease the drop mass of a drop emitted by an inkjet, the amplitude, or voltage level, of all or a portion of the drive signal is increased or decreased accordingly. In another embodiment, in order to increase or decrease the drop mass of some, but not all drops equally, the amplitude, or voltage level is increased or decreased on a jet-by-jet basis accordingly.

As part of a setup routine, the printheads of the imaging device are subjected to a normalization process as is known in the art to ensure ejected ink drops have substantially the same mass from nozzle to nozzle in a printhead as well as from printhead to printhead. As discussed above, however, thermal aging, or drift, may cause variability in drop mass, often resulting in a loss of drop mass over time. Previously known systems implemented an open loop drift controller that increased the voltage level of the firing signals over time to compensate for the loss in drop mass due to thermal aging. Drift behavior, however, may vary from printhead to printhead due to various factors such as variability in the physical characteristics or the electrical characteristics of printheads that may be introduced during printhead manufacture and assembly. Therefore, increasing the voltage level of the firing signals as a function of time may not be effective in maintaining a substantially uniform drop mass from printhead to printhead.

As an alternative to the open loop method of compensating for drop mass variations due to drift, an ink drop mass measurement method has been developed in which drop mass adjustments are made in accordance with changes in drop placement on the image receiving member. The placement of a drop on a receiving member, such as drum, depends on the rotating velocity of the drum and the velocity of the ink drop. The drum velocity may be accurately controlled. Therefore, the actual drop placement depends predominantly on drop velocity. A drop having a higher drop velocity has a shorter flight time between the inkjet nozzle and the image receiving member than a drop having a lower drop velocity because the distance from the nozzle to the image receiving member is the same for both drops. Consequently, the receiving member has more time to move in the process direction before the ink drop having the lower drop velocity reaches the member. Thus, the ink drop having the lower drop velocity lands on the image receiving member at a position that is further upstream in the process direction than the drop having the higher drop velocity. As is known in the art, the drop velocity of a drop ejected by an inkjet is closely correlated to the drop mass of the drop. Consequently, changes in drop mass of ink drops expelled by an inkjet may be detected by monitoring changes in the positions of the drops ejected by the same ejector in the process direction along the image receiving member.

Figure 3:
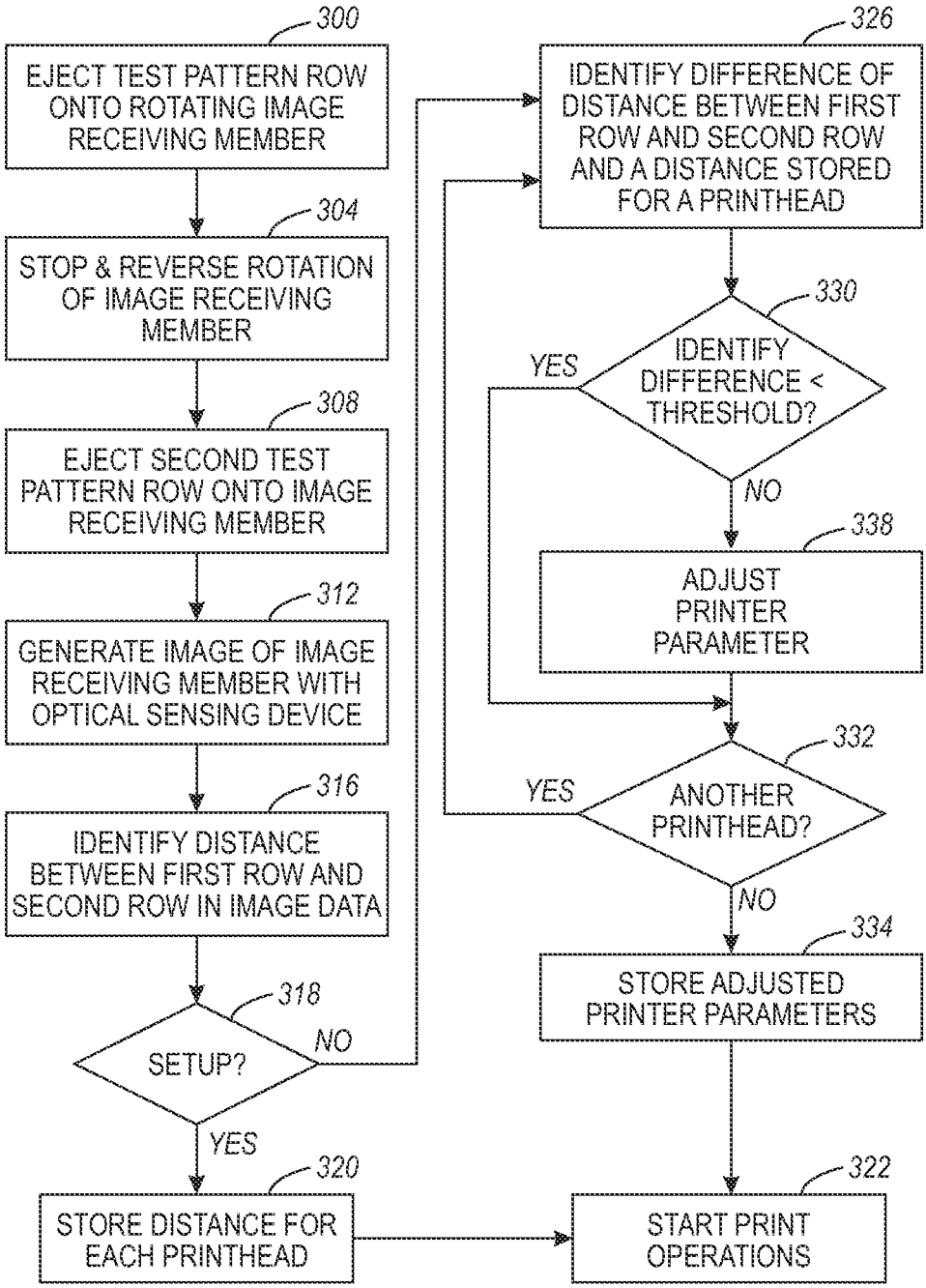
FIG. 3 is a flow diagram of an ink drop mass measurement method.

A method for measuring ink drop mass based on changes in drop placement data is shown in FIG. 3. The method begins with the ejection of a first test pattern row onto an image receiving member (block 300). To print a test pattern row, the controller 70 generates appropriate firing signals to the printhead assembly 42 to cause each inkjet in a printhead to eject a drop of ink having the default mass at a predetermined time to form a row in the cross-process direction across the image receiving member. The actual line generated on the image receiving member is likely to be offset from the expected placement of the line. While the actual printed line could be imaged and the difference between the actual ink drop positions identified from the image data and the expected ink drop positions obtained from the image data could then be measured to establish a set of firing parameters or characteristics for the printheads, the difference may be too small to measure accurately. Once printheads in an imaging system are aligned and normalized to a default drop mass, the deviations in the ink drop masses and velocities between inkjet ejectors is likely to produce actual versus expected differences of only a few microns. Such distances are difficult of resolve accurately by the optical imaging system described above.

To improve pattern measurement capability and the signal-to-noise ratio (SNR) for the image data captured by the optical imaging system, a second row is printed in a manner that enables the deviations to be more accurately detected by the optical imaging system at the beginning of the imaging system's operational life. To enable this detection, the process continues by stopping the image receiving member and reversing the rotational direction of the image receiving member (block 304). Once the image receiving member attains the same rotational velocity in the reverse direction as the member had when the first test pattern row was printed, the controller 70 generates appropriate firing signals to produce a second test pattern row of ink drops having the default mass on the image receiving member (block 308). The firing signals are generated to operate the inkjet ejectors in the printheads to print a second line on top of the expected position of the first line. The controller 70 then operates the optical sensing device 54 to generate image data of the surface of the image receiving member (block 312). The image data of the image receiving member is processed to identify a distance between the two lines (block 316). This distance is twice as large as the difference between the actual and expected positions for a single row as described above. By way of explanation, the first row deviated from the expected position by some first amount. After reversing the receiving member rotation, the second row is placed from the expected position by the same first amount, but in the opposite direction. By producing this indicator that corresponds to twice the error in line placement, the distance between the two lines is more accurately measured within the resolution of the optical sensing device. This distance corresponds to the velocity and mass of the ink drops ejected by the inkjet ejectors in a printhead. For an initial setup (block 318), this distance is stored for the printhead that printed a particular portion of each line as a baseline corresponding to the default mass and velocity of the inkjet ejectors in a printhead at the beginning of the operational life of the printer (block 320). Printing operations can then commence (block 322). In one embodiment, an average distance between the line portions printed by a printhead in the two rows is calculated and stored as the baseline for the inkjet ejectors of a printhead. The averaging of many printed patterns helps reduce noise in the image data signal. Another embodiment uses high precision scales at the factory to set the drop mass very accurately, subsequently measure the distance between the two lines, and store this information as a reference value.

While the initial measurement has been described with reference to the optical sensing device generating the image data, an alternative approach uses a paper based scanner. For example, test pattern rows are printed onto a recording medium, such as a sheet of paper, using the drum reversal technique and the printed sheet is scanned by the a scanner or similar image acquisition device in order to generate image data from which the distances between the portions of the two lines may be determined.

During the operational life of the imaging system, the test rows are printed and imaged to identify any change in the deviations of the inkjet ejectors. Specifically, the imaging system enters a test mode and performs the process of FIG. 3 until the distances between the portions of the two lines printed by the different printheads are measured (block 316) and the process determines that a setup is not active (block 318). Each difference between the distance measured between portions of the two lines printed by a printhead and the distance stored in memory for the printhead is identified (block 326). The difference between the two distances is compared to a threshold (block 330). If the difference is less than the threshold, the inkjet ejectors for the printhead are within tolerance and the process determines whether additional printheads are to be tested (block 332). If more printheads are to be tested, the process identifies the distance between the portions of the two lines printed by another printhead (block 326) and compares the difference to the threshold (block 330) to determine whether a printer parameter adjustment is needed. If the identified difference for any printhead is equal to or greater than the threshold, a printer parameter is adjusted (block 338). In another embodiment, the threshold is a window and the identified distance is compared to the window. If the identified distance is greater than or less than the window, a printer parameter is modified. If the identified distance is within the window, no printer parameter modification occurs. In one embodiment, the printer parameter is the default ink drop mass firing signal. This adjustment is made in one embodiment by increasing or decreasing the amplitude of the default mass firing signal. In other embodiments, other printer parameters are adjusted, such as the frequency of the firing signal or the temperature of the ink. The process determines whether other printheads are to be tested (block 332). Once all of the printheads have been tested and an appropriate printer parameter adjusted, if necessary, the adjusted printer parameters are stored in memory for the printhead controller (block 334) to enable the adjusted printer parameters to be used to operate the printer and produce ink drops at the initial default ink drop mass at the initial velocity. Printing operations are then resumed (block 322).

The testing of the printheads in one embodiment are periodically performed by setting a calibration interval. Calibration intervals may be stored in memory for access by the print controller. A calibration interval may be selected in any suitable manner. For example, a calibration interval may indicate that a calibration scan is to be performed after a predetermined amount of calendar time has elapsed, after a predetermined time at an operating temperature has transpired, or after a predetermined number of images have been printed. The intervals for performing the calibration scans may be adjusted depending on a number of factors such as, for example, print job characteristics and/or environmental conditions. For example, the interval may be adjusted based on the type of media, the type of ink, image type, environment, etc.

Figure 4:
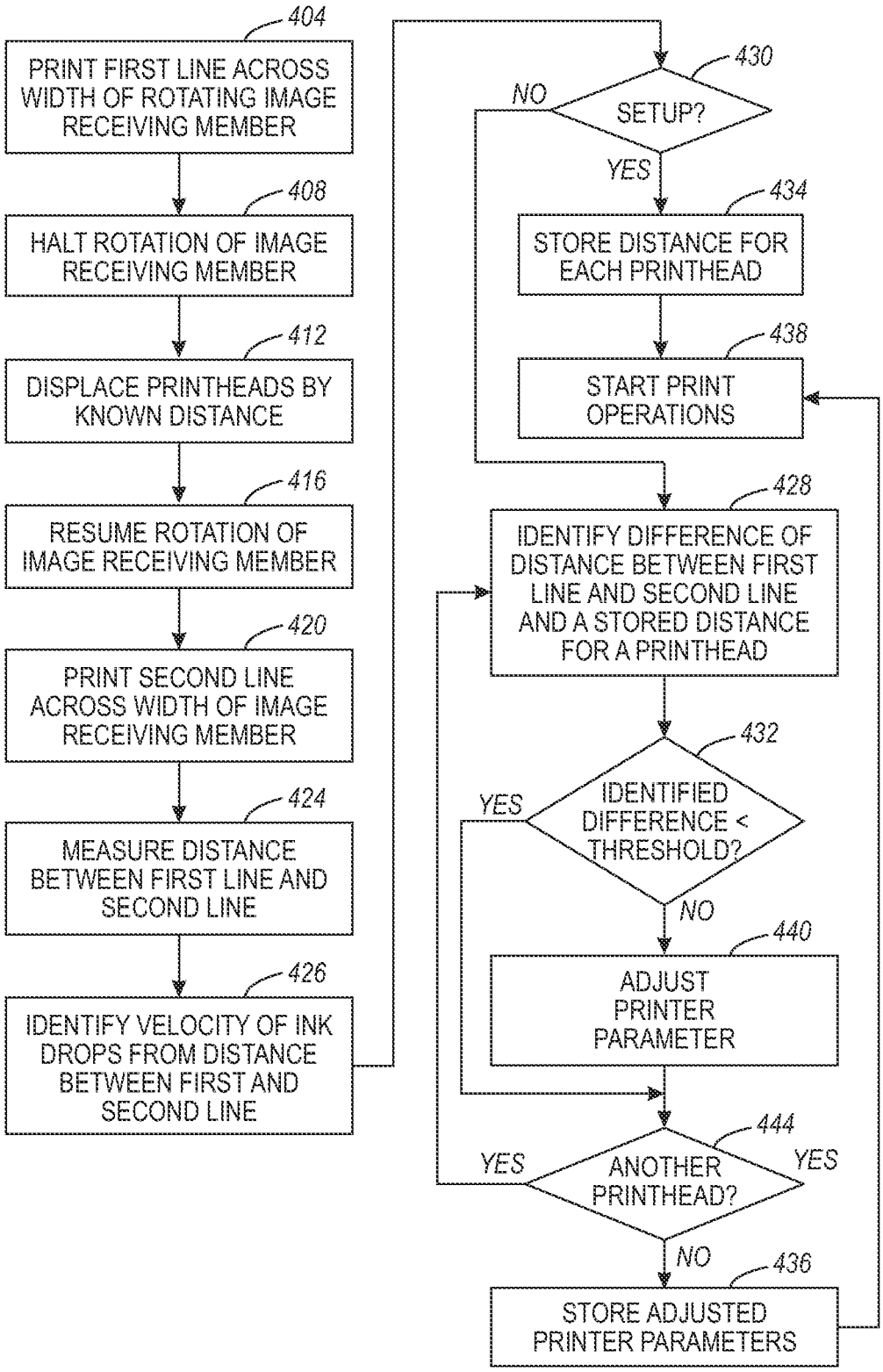
FIG. 4 is a flow diagram of another method for measuring ink drop mass.

Another method that measures changes in ink drop mass or velocity is depicted in FIG. 4. This process is similar to the method of FIG. 3 in that it uses the distance between lines to detect drop mass and velocity differences. It differs from the method described above in that it adjusts the distance between the inkjet ejectors and the image receiving member by a known amount to identify the velocity of ink drops ejected from an inkjet ejector. Specifically, the time required for an ink drop to travel from a nozzle to an image receiving member is equal to the distance between the nozzle and image receiving member divided by the velocity of the ink drop. An ink drop is then ejected from the printhead and its position on the image receiving member is identified. The inkjet ejector is then displaced from the image receiving member by a known distance. Another ink drop is ejected with timing to place the drop on the ink drop previously ejected by the inkjet ejector. The position of the drop on the image receiving member is identified. The distance between the two ink drops on the image receiving member corresponds to the increased length of time that the second drop took to cover the original distance between the ejector and the image receiving surface plus the displaced distance and the surface speed of the image receiving member. Consequently, the velocity of the ink drop can be identified from the measured distance between the drops, the known displacement of the inkjet ejector, and the surface speed of the image receiving member.

These principles are used in the process of FIG. 4. That process begins as the one in FIG. 3 begins with the printing of a line using every inkjet ejector of all of the printheads required to produce a line across the width of the image receiving member in the cross-process direction (block 404). In one embodiment this line is one pixel thick, while in other embodiments, the line is composed of a plurality of pixels. Rotation of the image receiving member is halted (block 408) and the printheads are displaced by a known distance (block 412). The displacement of the printheads is achieved in one embodiment by positioning a spacer to displace the printheads from the image receiving member. In one embodiment, this space is positioned by rotating a printhead assembly away from the image receiving member and covering each docking pin on the printhead assembly with a space, such as a cap, having a known thickness. The printhead assembly is then returned to its home position. The thickness of the spacers now displaces the aperture plates of the printheads from the image receiving member by a known distance. Rotation of the image receiving member is resumed (block 416) and another line is printed (block 420). The distance between each portion of the two lines on the image receiving member printed by a printhead is measured as described above in FIG. 3 (block 424). As noted above, the distance is related to the velocity of the ink drops and this velocity can be calculated for each printhead (block 426). In one embodiment, the direction of the image receiving member rotation is also reversed to increase the ability to image and measure the distance between the lines. The process determines whether a setup operation has finished (block 430), and printing operations begin if a setup was being performed (block 438). In one embodiment, an average distance between the line portions printed by a printhead in the two rows is calculated and stored as the baseline for the inkjet ejector of a printhead to help reduce noise in the image data signal.

During the operational life of the imaging system, the first test row is printed, the printheads displaced by the known distance, the second test row printed, and the lines imaged to identify any change in the deviations of the inkjet ejectors. Specifically, the imaging system enters a test mode and performs the process of FIG. 4 until the distance between the portions of the two lines are measured (block 424) and the process determines that a setup operation is not occurring (block 430). Each difference between the distance measured between portions of the two lines printed by a printhead and the distance stored in memory for the printhead is identified (block 428). The difference between the two distances is compared to a threshold (block 432). If the difference is less than the threshold, the inkjet ejectors are within tolerance and the process determines whether additional printheads are to be tested (block 444). If more printheads are to be tested, the process identifies the distance between portions of the two lines printed by another printhead (block 428) and compares the difference to the threshold (block 432) to determine whether a printer parameter adjustment is needed. If the identified difference for any printhead is equal to or greater than the threshold, an appropriate printer parameter is adjusted (440). In one embodiment, the adjusted printer parameter is the firing signal for the default ink drop mass. In one embodiment, the default ink drop mass firing signal is adjusted by increasing or decreasing the amplitude of the default mass firing signal. In other embodiments, other printer parameters may be adjusted, such as the frequency of the firing signal or the temperature of the ink. The process determines whether other printheads are to be tested (block 444). Once all of the printheads have been tested and printer parameters adjusted, if necessary, the adjusted printer parameters are stored in memory for the printhead controller (block 436) to enable the adjusted printer parameters to be used to operate the inkjet nozzles and produce ink drops at the initial default ink drop mass at the initial velocity. As noted above, the distances between lines are determined in one embodiment by averaging the distances between drops in the portion of a line generated by a printhead.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of adjusting an imaging device, the method comprising:

ejecting a first line of fluid drops across a rotating image receiving member in a cross-process direction;

ejecting a second line of fluid drops across the rotating image receiving member in the cross-process direction, the second line being generated to be placed on the first line of fluid drops;

identifying a distance between a first portion of the first line of fluid drops and a first portion of the second line of fluid drops;

storing the identified distance in association with a printhead that ejected the fluid drops in the first portion of the first line of fluid drops and the first portion of the second line of fluid drops;

cleaning a surface of the rotating image receiving member;

ejecting a third line of fluid drops across the rotating image receiving member in the cross-process direction;

ejecting a fourth line of fluid drops across the rotating image receiving member in the cross-process direction, the fourth line being generated to be placed on the third line of fluid drops;

identifying a distance between a first portion of the third line of fluid drops and a first portion of the fourth line of fluid drops;

comparing the identified distance between the first portions of the third line and the fourth line to the identified distance stored in association with the printhead that ejected the fluid drops in the first portion of the third line of fluid drops and the first portion of the fourth line of fluid drops; and modifying a printer parameter in response to the identified distance exceeding the identified distance stored in association with the printhead that ejected the fluid drops in the first portion of the third line of fluid drops and the first portion of the fourth line of fluid drops by a predetermined amount.

2. The method of claim 1, further comprising:

reversing a rotational direction of the rotating image receiving member before ejecting the second line of fluid drops.

3. The method of claim 1, the identification of the distance between the first portion of the first line and the first portion of the second line further comprising:

generating image data of the first line of fluid drops and the second line of fluid drops on the rotating image receiving member; and identifying the distance between the first portion of the first line of fluid drops and the first portion of the second line of fluid drops with reference to the image data.

4. The method of claim 3, the generation of the image data further comprising:

operating an optical sensing device in the imaging device to generate the image data.

5. The method of claim 1 further comprising:

modifying the printer parameter in response to the identified distance being less than the identified distance stored in association with the printhead that ejected the fluid drops in the first portion of the third line of fluid drops and the first portion of the fourth line of fluid drops by the predetermined amount.

6. The method of claim 5, the modification of the printer parameter further comprising:

adjusting a voltage amplitude of a firing signal in response to the identified distance being greater than or less than the identified distance stored in association with the printhead that ejected the fluid drops in the first portion of the third line of fluid drops and the first portion of the fourth line of fluid drops by the predetermined amount.

7. The method of claim 5, the modification of the printer parameter further comprising:

adjusting a frequency of a firing signal in response to the identified distance being greater than or less than the identified distance stored in association with the printhead that ejected the fluid drops in the first portion of the third line of fluid drops and the first portion of the fourth line of fluid drops by the predetermined amount.

8. The method of claim 5, the modification of the printer parameter further comprising:

adjusting an ink temperature in response to the identified distance being greater than or less than the identified distance stored in association with the printhead that ejected the fluid drops in the first portion of the third line of fluid drops and the first portion of the fourth line of fluid drops by the predetermined amount.

9. A method of adjusting an imaging device, the method comprising:

ejecting with printheads a first line of fluid drops across a rotating image receiving member in a cross-process direction;

displacing each printhead that ejected the first line of fluid drops by a predetermined distance;

ejecting with printheads a second line of fluid drops across the rotating image receiving member in the cross-process direction, the second line being generated to be placed on the first line of fluid drops;

identifying a distance between a first portion of the first line of fluid drops and a first portion of the second line of fluid drops;

storing the identified distance in association with a printhead that ejected the fluid drops in the first portion of the first line of fluid drops and the first portion of the second line of fluid drops;

cleaning a surface of the rotating image receiving member;

ejecting with printheads a third line of fluid drops across the rotating image receiving member in the cross-process direction;

displacing each printhead that ejected the third line of fluid drops by the predetermined distance;

ejecting with printheads a fourth line of fluid drops across the rotating image receiving member in the cross-process direction, the fourth line being generated to be placed on the third line of fluid drops;

identifying a distance between a first portion of the third line of fluid drops and a first portion of the fourth line of fluid drops;

comparing the identified distance between the first portions of the third and fourth lines to the identified distance stored in association with the printhead that ejected the fluid drops in the first portion of the third line of fluid drops and the first portion of the fourth line of fluid drops; and modifying a printer parameter in response to the identified distance being greater than the identified distance stored in association with the printhead that ejected the fluid drops in the first portion of the third line of fluid drops and the first portion of the fourth line of fluid drops by a predetermined amount.

10. The method of claim 9 further comprising:

reversing a rotational direction of the rotating image receiving member before ejecting the second line of fluid drops.

11. The method of claim 9, the identification of the distance between the first portion of the first line and the first portion of the second line further comprising:

generating image data of the first line of fluid drops and the second line of fluid drops on the rotating image receiving member; and identifying the distance between the first portion of the first line of fluid drops and the first portion of the second line of fluid drops with reference to the image data.

12. The method of claim 11, the generation of the image data further comprising:

operating an optical sensing device in the imaging device to generate the image data.

13. The method of claim 9, the modification of the printer parameter further comprising:

modifying the printer parameter in response to the identified distance being less than the identified distance stored in association with the printhead that ejected the fluid drops in the first portion of the third line of fluid drops and the first portion of the fourth line of fluid drops by the predetermined amount.

14. The method of claim 13, the modification of the printer parameter further comprising:

adjusting a voltage amplitude of a firing signal in response to the identified distance being greater than or less than the identified distance stored in association with the printhead that ejected the fluid drops in the first portion of the third line of fluid drops and the first portion of the fourth line of fluid drops by the predetermined amount.

15. The method of claim 13, the modification of the printer parameter further comprising:

adjusting a frequency of a firing signal in response to the identified distance being greater than or less than the identified distance stored in association with the printhead that ejected the fluid drops in the first portion of the third line of fluid drops and the first portion of the fourth line of fluid drops by the predetermined amount.

16. The method of claim 13, the modification of the printer parameter further comprising:

adjusting an ink temperature in response to the identified distance being greater than or less than the identified distance stored in association with the printhead that ejected the fluid drops in the first portion of the third line of fluid drops and the first portion of the fourth line of fluid drops by the predetermined amount.

17. The method of claim 9, the displacing of the printheads that ejected the third line of ink drops by the predetermined distance further comprising:

stopping rotation of the rotating image receiving member;

undocking a printhead assembly having the printheads that prints the third and fourth lines; and positioning a spacer to displace by the predetermined distance each printhead that ejected fluid for the first line of fluid drops.

18. A system for identifying changes in drop mass in an inkjet printer, the system comprising:

an optical sensing device configured to generate image data of a surface of a rotating image receiving member;

a printhead assembly having a plurality of printing devices that eject fluid towards a surface of the rotating image receiving member; and a controller operatively connected to the optical sensing device and the printhead assembly, the controller being configured to operate the printheads in the printhead assembly to eject a first line of fluid drops across the rotating image receiving member in a cross-process direction and to eject a second line of fluid drops across the rotating image receiving member in the cross-process direction, the second line being generated to be placed on the first line of fluid drops, to identify a distance between a first portion of the first line of fluid drops and a first portion of the second line of fluid drops, to store the identified distance in association with a printhead that ejected the fluid drops in the first portion of the first line of fluid drops and the first portion of the second line of fluid drops, to operate a device to clean the surface of the rotating image receiving member, to operate the printheads in the printhead assembly to eject a third line of fluid drops across the rotating image receiving member in the cross-process direction and to eject a fourth line of fluid drops across the rotating image receiving member in the cross-process direction, the fourth line being generated to be placed on the third line of fluid drops, to identify a distance between a first portion of the third line of fluid drops and a first portion of the fourth line of fluid drops, to compare the identified distance between the first portions of the third and fourth lines to the identified distance stored in association with the printhead that ejected the fluid drops in the first portion of the third line of fluid drops and the first portion of the fourth line of fluid drops, and to modify a printer parameter in response to the identified distance being greater than or less than the identified distance stored in association with the printhead that ejected the fluid drops in the first portion of the third line of fluid drops and the first portion of the fourth line of fluid drops by a predetermined amount.

19. The system of claim 18, the controller being further configured to reverse a rotational direction of the rotating image receiving member before ejecting the second line of fluid drops.

20. The system of claim 18, the controller being further configured to displace each printhead that ejected the first line of fluid drops by a predetermined distance.

* * * * *